US006720543B2

(12) United States Patent
Yang

(10) Patent No.: US 6,720,543 B2
(45) Date of Patent: Apr. 13, 2004

(54) WALL-MOUNTED TYPE MICROWAVE OVEN WITH CLEANING DEVICE

(75) Inventor: Ha-Yeong Yang, Yongin (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 0 days.

(21) Appl. No.: 10/316,854

(22) Filed: Dec. 12, 2002

(65) Prior Publication Data

US 2004/0050844 A1 Mar. 18, 2004

(30) Foreign Application Priority Data

Sep. 14, 2002 (KR) ..... 10-2002-55988

(51) Int. Cl.[7] ..... H05B 6/80
(52) U.S. Cl. ..... 219/757; 219/400; 126/299 D
(58) Field of Search ..... 219/757, 400; 126/21 A, 299 R, 299 D

(56) References Cited

U.S. PATENT DOCUMENTS 3,356,008 A * 12/1967 Simpson et al. ..... 126/299 D
5,866,886 A * 2/1999 Lange et al. ..... 219/757
5,986,245 A * 11/1999 Kang ..... 219/702

FOREIGN PATENT DOCUMENTS

| | | | |
|---|---|---|---|
| JP | 3-17458 | | 1/1991 |
| JP | 6-137629 | * | 5/1994 |
| JP | 6-137630 | * | 5/1994 |
| JP | 11-304213 | * | 11/1999 |
| KR | 1997-11181 | * | 7/1997 |

* cited by examiner

*Primary Examiner*—Philip H. Leung
(74) *Attorney, Agent, or Firm*—Staas & Halsey LLP

(57) ABSTRACT

A wall-mounted type microwave oven includes a cleaning device which is in contact with a guide plate and cleans the guide plate during an extension and/or retraction of the guide plate. The cleaning device includes brushes which are in contact with upper and lower surfaces of the guide plate, and detergent containers which support the brushes and receive detergent therein. The detergent containers include detergent inlets so as to allow the detergent to be injected to the brushes. Since the guide plate slides and is in contact with the brushes containing the detergent, the guide plate is always maintained in a clean condition. That is, the cleaning operation of the guide plate is automatically performed in response to a moving operation of the guide plate.

21 Claims, 4 Drawing Sheets

WALL-MOUNTED TYPE MICROWAVE OVEN WITH CLEANING DEVICE

CROSS-REFERENCE TO RELATED APPLICATION

This application claims the benefit of Korean Patent Application No. 2002-55988, filed Sep. 14, 2002 in the Korean Intellectual Property Office, the disclosure of which is incorporated herein by reference.

BACKGROUND OF THE INVENTION

1. Field of the Invention

The present invention relates to a wall-mounted type microwave oven, and more particularly, to a wall-mounted type microwave oven having a cleaning device which cleans a guide plate of the microwave oven. The guide plate directs steam and fumes generated therebelow toward an exhaust duct of the microwave oven.

2. Description of the Related Art

Generally, a wall-mounted type microwave oven is installed on a wall above an oven range, and is provided therein with a hood motor and an exhaust duct to exhaust steam and fumes generated therebelow to the outside of the microwave oven.

Such a wall-mounted type microwave oven includes a guide plate which directs steam and fumes toward an exhaust duct. The guide plate slides back and forth to cover, for example, a location of food being cooked by an oven range.

However, where the wall-mounted type microwave oven cannot quickly exhaust a large amount of steam and fumes generated during a cooking operation, the steam and fumes cling to surfaces of the guide plate. Therefore, the guide plate is deteriorated in terms of sanitary aspect and appearance, and thus it is necessary for a user to frequently and manually clean the guide plate.

SUMMARY OF THE INVENTION

Accordingly, an aspect of the present invention is to provide a wall-mounted type microwave oven having a cleaning device which removes contaminants adhered to a guide plate of the microwave oven.

Additional aspects and advantages of the invention will be set forth in part in the description which follows and, in part, will be obvious from the description, or may be learned by practice of the invention.

To achieve the above and/or other aspects of the present invention, there is provided a wall-mounted type microwave oven according to an embodiment of the present invention which comprises an oven body, an exhaust duct provided in the oven body to exhaust fumes, a guide plate provided in the oven body to guide the fumes generated therebelow toward the exhaust duct, and a cleaning device which removes contaminants adhered to at least one surface of the guide plate during a sliding of the guide plate.

BRIEF DESCRIPTION OF THE DRAWINGS

These and other aspects and advantages of the present invention will become apparent and more readily appreciated from the following description of the embodiments, taken in conjunction with the accompanying drawings of which.

DETAILED DESCRIPTION OF THE EMBODIMENTS

Figure 1:
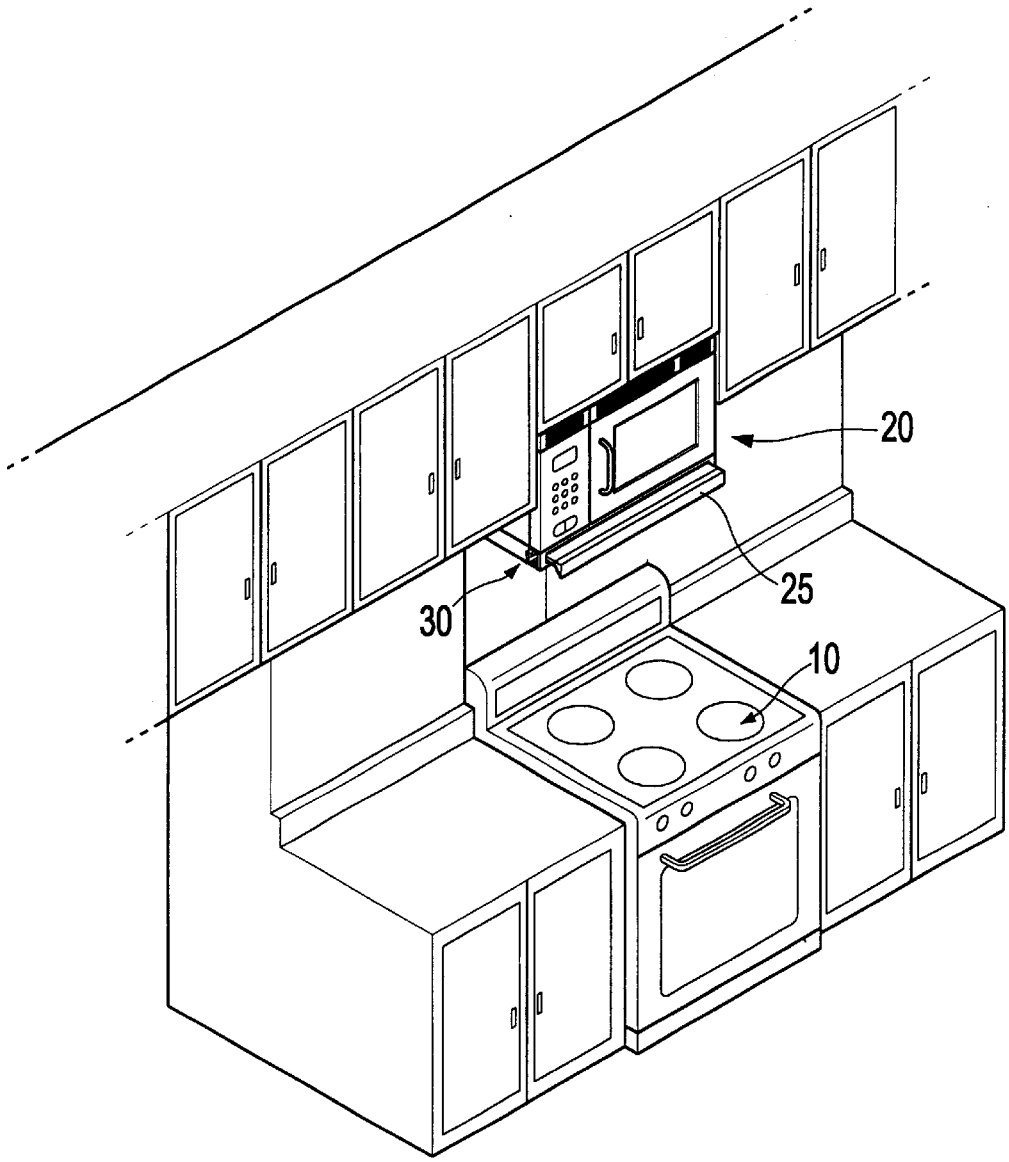
FIG. 1 is a perspective view illustrating a wall-mounted type microwave oven according to the present invention, which is installed on a wall of a cooking space.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 2:
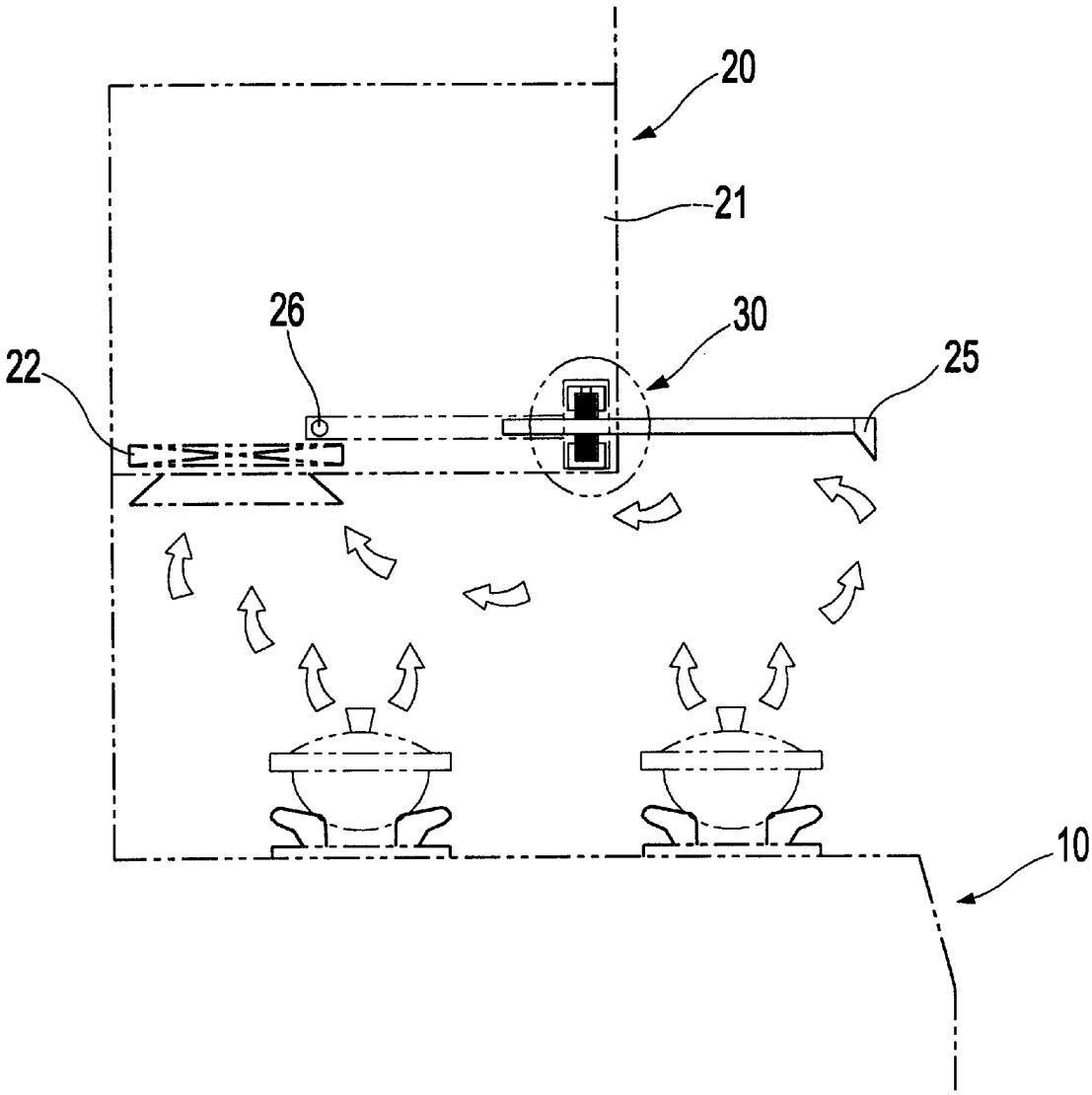
FIG. 2 is a side view of the wall-mounted type microwave oven shown in FIG. 1, in which a guide device is pulled out of an oven body.

FIG. 1 shows a perspective view of a wall-mounted type microwave oven 20 according to the present invention, which is installed on a wall of a cooking space. FIG. 2 shows a side view of the wall-mounted type microwave oven 20 shown in FIG. 1, in which a guide device 25 is pulled out of an oven body 21.

As shown in FIG. 2, the microwave oven 20 according to the present invention is installed on a wall over an oven range 10. The microwave oven 20 includes the guide plate 25 which guides steam and fumes generated from the oven range 10, during a cooking operation, toward an exhaust duct 22 (shown in FIG. 2) of the microwave oven 20, and a cleaning device 30 which cleans the guide plate 25. The guide plate 25 extends forward and retracts back into the oven body 21. The guide plate 25 includes a stop protrusion 26 which prevents the guide plate 25 from being separated from the oven body 21.

Figure 3:
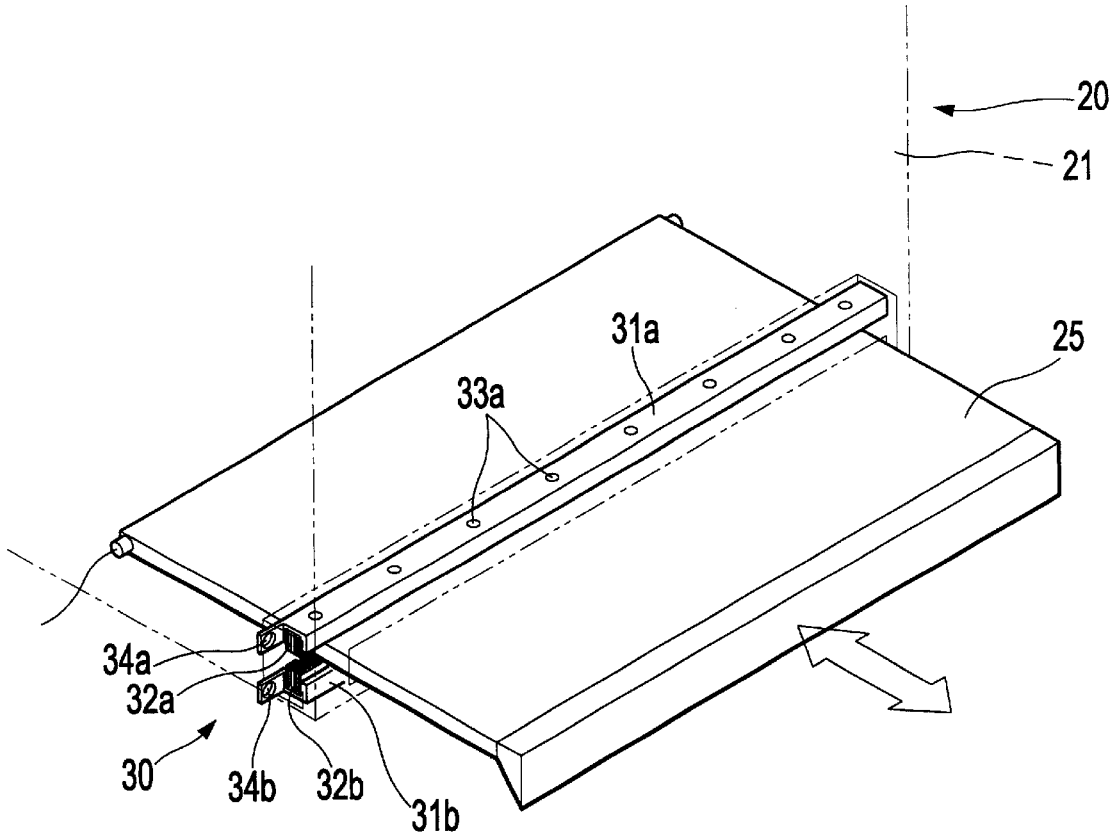
FIG. 3 is a perspective view of cleaning device of the wall-mounted type microwave oven shown in FIG. 2.
Figure 4:
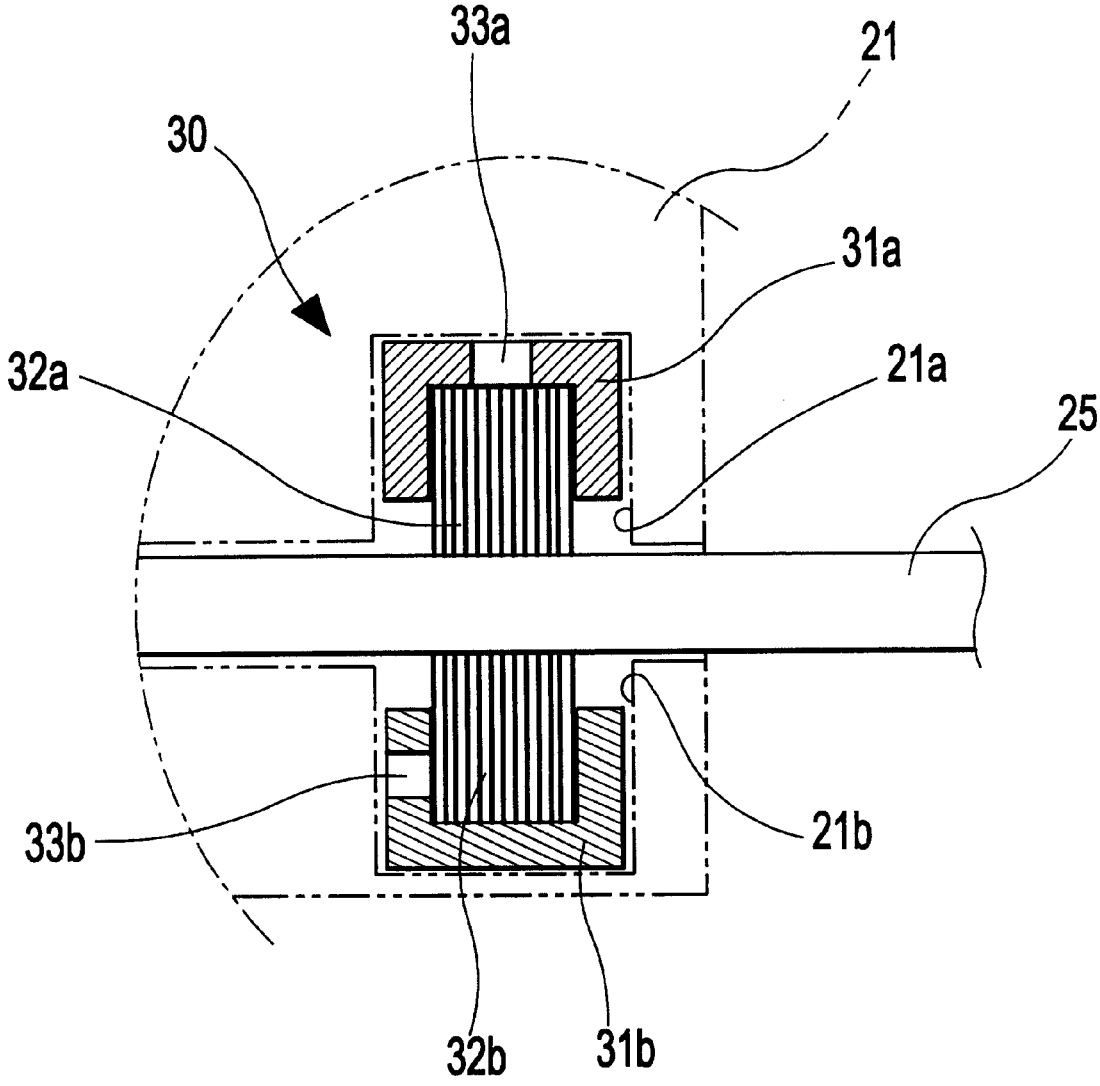
FIG. 4 is a side cross-sectional view of the cleaning device shown in FIG. 3.

FIG. 3 shows a perspective view of the cleaning device 30, along with the guide plate 25, of the wall-mounted type microwave oven shown in FIG. 2. FIG. 4 shows a side cross-sectional view of the cleaning device 30 shown in FIG. 3.

The cleaning device 30 includes upper and lower brushes 32*a* and 32*b* which remove contaminants adhered to the guide plate 25 during a sliding of the guide plate 25. The cleaning device 30 also includes upper and lower detergent containers 31*a* and 31*b* which support the respective upper and lower brushes 32*a* and 32*b*, and contain detergent therein. The upper detergent container 31*a* and the upper brush 32*a*, and the lower detergent container 31*b* and the lower brush 32*b* are disposed to face each other so as to clean upper and lower surfaces of the guide plate 25.

The upper and lower brushes 32*a* and 32*b* are spaced from each other so as have the upper and lower brushes 32*a* and 32*b* come into a proper contact with the upper and lower surfaces of the guide plate 25.

Referring to FIG. 4, the upper detergent container 31*a* is detachably fitted into a fitting groove 21*a* formed at the oven body 21. The upper detergent container 31*a* is longitudinally provided with a plurality of detergent inlets 33*a* having corresponding spaces therebetween, so as to easily inject detergent to the upper brush 32*a*.

Similar to the upper detergent container 31*a*, the lower detergent container 31*b* is detachably fitted into a fitting groove 21*b* formed at the oven body 21. The lower detergent container 31*b* is longitudinally provided with a plurality of detergent inlets 33*b* having corresponding spaces therebetween, so as to easily inject detergent to the lower brush 32*b*.

Referring back to FIG. 3, the upper and lower detergent containers 31*a* and 31*b* include corresponding knobs 34*a* and 34*b* which are provided at their respective ends. Accordingly, a user can take the detergent containers 31*a* and 31*b* out of the oven body 21 by operating the knobs 34*a* and 34*b*, and replenish the detergent containers 31*a* and 31*b* with detergent through the detergent inlets 33*a* and 33*b*.

Referring back to FIG. 2, the guide plate 25 is extended forward by a user to guide steam and fumes, as shown by arrows, toward an exhaust duct 22 of the microwave oven 20. More specifically, where steam and fumes are introduced into the exhaust duct 22 by a suction force of a hood motor (not shown) provided in the oven body 21, the forwardly extended guide plate 25 guides the steam and fumes toward the exhaust duct 22.

Where a cooking operation by the oven range 10 is completed or where a cooking operation is performed just below the exhaust duct 22, the guide plate 25 can be retracted into the oven body 21.

According to the present invention, where the guide plate 25 is extended forward or retracted backward, contaminants adhered to the upper and lower surfaces of the guide plate 25 can be removed by the upper and lower brushes 32*a* and 32*b*, with the aid of detergent contained in the upper and lower containers 31*a* and 31*b*, because the upper and lower brushes 32*a* and 32*b* are in contact with the upper and lower surfaces of the guide plate 25.

Although the upper and lower brushes 32*a* and 32*b* are explained to be in contact with the upper and lower surfaces of the guide plate 25, the number and position of the brushes may be changed according to contaminated areas of the guide plate 25. Furthermore, to reduce production cost of the wall-mounted type microwave oven, only one of the upper and lower surfaces of the guide plate 25 may be provided with a cleaning brush.

As described above, the present invention provides a wall-mounted type microwave oven having a cleaning device which cleans at least one surface of a guide plate of the microwave oven. The guide plate guides steam and fumes generated therebelow during a cooking operation of an oven range toward an exhaust duct of the microwave oven. Accordingly, the guide plate is maintained in a clean condition. The cleaning operation of the guide plate is easily carried out, and detergent is conveniently replenished in the cleaning device.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A wall-mounted type microwave oven, comprising:

an oven body;

an exhaust duct provided in the oven body to exhaust fumes;

a guide plate slidably provided in the oven body to guide the fumes generated therebelow toward the exhaust duct; and a cleaning device which removes contaminants adhered to at least one surface of the guide plate where the guide plate slides past the cleaning device.

2. The wall-mounted type microwave oven as set forth in claim 1, wherein the cleaning device comprises:

a brush unit which is provided to be in contact with the one surface of the guide plate; and a detergent container which supports the brush unit and receives detergent therein.

3. The wall-mounted type microwave oven as set forth in claim 2, further comprising a fixing groove formed on a surface of the oven body, wherein the detergent container has a handling knob at an end thereof, and is detachably fitted into the fixing groove.

4. The wall-mounted type microwave oven as set forth in claim 1, wherein the cleaning device comprises:

first and second brush units which are in contact with corresponding top and bottom surfaces of the guide plate; and first and second detergent containers which support the corresponding first and second brush units, and receive detergent therein.

5. The wall-mounted type microwave oven as set forth in claim 2, wherein the detergent container includes a detergent inlet which allows the detergent to be injected to the brush unit.

6. The wall-mounted type microwave oven as set forth in claim 4, wherein the first and second detergent containers include corresponding detergent inlets which allow the detergent to be supplied to the first and second brush units.

7. The wall-mounted type microwave oven as set forth in claim 6, wherein the first and second detergent containers, along with the first and second brush units, are removably provided in the oven body.

8. A cooking apparatus, comprising:

an oven body;

a heating unit disposed in the oven body so as to cook food;

an exhaust duct provided in the oven body to exhaust fumes;

a guide plate slidably provided in the oven body to guide the fumes therebelow toward the exhaust duct; and a cleaning device disposed in the oven body which removes contaminants adhered to at least one surface of the guide plate.

9. The cooking apparatus as set forth in claim 8, wherein the cleaning device is removably installed in the oven body and removes the contaminants as the guide plate slides past the cleaning device.

10. The cooking apparatus as set forth in claim 8, wherein the cleaning device comprises:

a brush unit which contacts and cleans the one surface of the guide plate as the guide plate slides past the brush unit; and a detergent container which supports the brush unit and supplies detergent therein to the brush unit.

11. The cooking apparatus as set forth in claim 8, wherein the cleaning device comprises:

first and second brush units which contact and clean corresponding top and bottom surfaces of the guide plate as the guide plate slides past the cleaning device; and first and second detergent containers which support the corresponding first and second brush units, and supply detergent therein to the first and second brush units.

12. The cooking apparatus as set forth in claim 8, wherein the heating unit includes a magnetron which generates microwaves to cook the food.

13. The cooking apparatus as set forth in claim 8, wherein the cooking apparatus is a wall-mountable microwave oven.

14. An exhaust guiding apparatus of a mountable cooking unit having an exhaust duct to exhaust fumes therebelow, the exhaust guiding apparatus comprising:

a guide plate which guides the fumes toward the exhaust duct; and a cleaning device attached between the cooking unit and the guide plate and which removes contaminants adhered to at least one surface of the guide plate as the guide plate and the cleaning device slide past each other.

15. The exhaust guiding apparatus as set forth in claim 14, wherein the cleaning device is detachable from a surface above the guide plate and when attached, removes the contaminants during at least one of an extending operation and a retracting operation of the guide plate.

16. The exhaust guiding apparatus as set forth in claim 14, wherein the cleaning device removes the contaminants as the guide plate slides past the cleaning device.

17. The exhaust guiding apparatus as set forth in claim 16, wherein the cleaning device comprises:

first and second brush units which are provided to be in contact with corresponding top and bottom surfaces of the guide plate so as to clean the guide plate as the guide plate slides past the cleaning device; and first and second detergent containers which support the corresponding first and second brush units, and supply detergent therein to the first and second brush units.

18. The exhaust guiding apparatus as set forth in claim 14, wherein the cleaning device comprises:

a brush unit which selectively contacts and cleans the one surface of the guide plate as the guide plate slides past the brush unit; and a detergent container which supports the brush unit and supplies detergent therein to the brush unit.

19. The exhaust guiding apparatus as set forth in claim 14, wherein the cleaning device comprises:

a brush unit which is provided to be in contact with the one surface of the guide plate so as to clean the guide plate as the guide plate slides past the brush unit; and a detergent container which supports the brush unit and supplies detergent therein to the brush unit.

20. The exhaust guiding apparatus as set forth in claim 14, wherein the cleaning device comprises:

first and second brush units which selectively contact corresponding top and bottom surfaces of the guide plate and clean the guide plate as the guide plate slides past the cleaning device; and first and second detergent containers which support the corresponding first and second brush units, and supply detergent therein to the first and second brush units.

21. A cooking apparatus, comprising:

an oven body;

a heating unit disposed in the oven body so as to cook food;

an exhaust duct provided in the oven body to exhaust fumes;

a guide plate slidably provided in the oven body to guide the fumes therebelow toward the exhaust duct; and a cleaning device comprising:

a brush unit which contacts and cleans the a surface of the guide plate as the guide plate slides past the brush unit, and a detergent container which supports the brush unit and supplies detergent therein to the brush unit.

* * * * *